United States Patent [19]

Nowatzki

[11] 4,007,505

[45] Feb. 15, 1977

[54] FLEXIBLE STABILIZER FOR UNDERWATER VEHICLE

[75] Inventor: James A. Nowatzki, Northridge, Calif.

[73] Assignee: The United States of America as represented by the Secretary of the Navy, Washington, D.C.

[22] Filed: Nov. 10, 1975

[21] Appl. No.: 630,570

[52] U.S. Cl. ..... 9/8 R; 340/2

[51] Int. Cl.[2] ..... B63B 21/52

[58] Field of Search ..... 9/8 R; 114/206 R, 209; 102/4; 244/138 A, 3.28, 3.29, 3.3; 340/2; 46/82, 85

[56] References Cited

UNITED STATES PATENTS

| | | | |
|---|---|---|---|
| 308,944 | 12/1884 | Bartlett | 244/3.3 |
| 3,115,831 | 12/1963 | Suter | 244/138 A |
| 3,439,537 | 4/1969 | Pullos | 9/8 R |

*Primary Examiner*—Trygve M. Blix
*Assistant Examiner*—Sherman D. Basinger
*Attorney, Agent, or Firm*—Richard S. Sciascia; Don D. Doty; Harvey A. David

[57] ABSTRACT

A stabilizing drag and spin inducing device is described for an instrumented underwater vehicle. A flexible plastic disc having a central aperture and segmented into angularly offset vanes is pressed onto the vehicle probe section with resulting distortion causing the disc to assume a conical configuration. The vanes flex to increase drag on descent and decrease drag on ascent, while also assuming spin inducing pitch.

3 Claims, 4 Drawing Figures

FLEXIBLE STABILIZER FOR UNDERWATER VEHICLE

STATEMENT OF GOVERNMENT INTEREST

The invention described herein may be manufactured and used by or for the Government of the United States of America for governmental purposes without the payment of any royalties thereon or therefor.

FIELD OF THE INVENTION

This invention relates to unmanned underwater hovering vehicles such as may be used for scientific or military purposes, and more particularly to an improved drag brake device for providing attitude stability of a vehicle about a vertical axis as it alternates between powered upward movement and retarded sinking movement to maintain position between predetermined depths.

DISCUSSION OF THE PRIOR ART

Previous devices for performing a speed stabilizing function for underwater vehicles have included parachutes and articulated drag brakes. These have shown considerable success, particularly in the cases of air dropped electronic instrumentation vehicles, bombs, mines, and the like. Their adaptation, however, to a small hovering vehicle that can be launched from a tube, and will make repeated ascents and descents to maintain depth in a predetermined range, has not been so successful. Parachutes have the disadvantage of being very unreliable for multiple deployments and of requiring a group of shroud lines for attachment to the vehicle. Folding drag brakes have the disadvantages of being expensive, undesirably heavy, and subject to damage because of their articulating hinges.

SUMMARY OF THE INVENTION

The present invention aims to overcome most or all of the disadvantages of prior art drag producing and stabilizing devices through the provision of a novel, flexible plastic drag brake device that is capable of operating repeatedly, in a uniform manner, through cycles of vehicle ascension and descension, and to permit storage and launching without damage.

With the foregoing in mind, it is a principal object of the invention to provide an improved drag brake for providing stability and control of speed of an underwater vehicle that cycles through powered ascents and sinking descents along a substantially vertical axis.

Another important object is the provision of a reliable drag brake and stabilizing device that is low in cost for use with expendible, instrumented vehicles.

Yet another object is the provision of a drag brake device that is light in weight and capable of being stored in a compact condition for long periods of time prior to launch, without loss of reliability of operation.

Other objects and many of the attendant advantages will be readily appreciated as the subject invention becomes better understood by reference to the following detailed description, when considered in conjunction with the accompanying drawings.

DESCRIPTION OF THE PREFERRED EMBODIMENT

Figure 1:
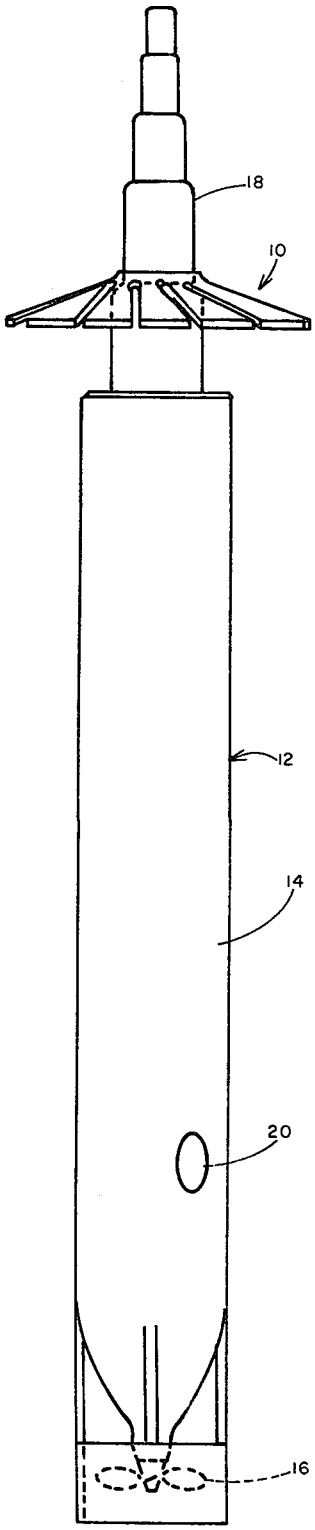
FIG. 1 is a side elevational view of a flexible drag brake device embodying the invention and shown in association with an instrumented underwater vehicle.

In the form of the invention illustrated in the drawings and described hereinafter, a flexible drag brake device 10 serves to provide stabilizing rotation and hydrodynamic drag to a vehicle 12 as it alternates between powered ascents and retarded descents in order to stay within a predetermined range of depths. Vehicle 12 comprises an elongate, cylindrical hull 14 carrying a suitable propulsion motor, preferably electric, for intermittently driving a propeller 16. Hull 14 also carries batteries and electronic equipment associated with sensors, transducers, or other instrumentation elements in a probe portion 18 of the vehicle, characterized by reduced diameters and located at the end of the vehicle opposite the propeller 16. The nature of the instrumentation and the purposes thereof are not material to the invention.

Vehicle 12, which is slightly negatively bouyant, preferably has its center of bouyancy located above its center of gravity when the vehicle is oriented as illustrated in FIG. 1 with its longitudinal axis vertical. Accordingly, the vertical position illustrated is the normal operating attitude of the vehicle, with the propeller 16 at the bottom end, and the probe 18 and the drag brake and stabilizing device 10 at the upper end. A hydrostatic pressure sensor 20 is adapted to initiate operation of propeller 16 whenever vehicle 12 sinks to a predetermined lower depth and to terminate operation of the propeller whenever the vehicle has been driven upward thereby to a predetermined upper depth. The upper and lower depths defining the range of ascending and descending excursions of the vehicle.

Figure 2:
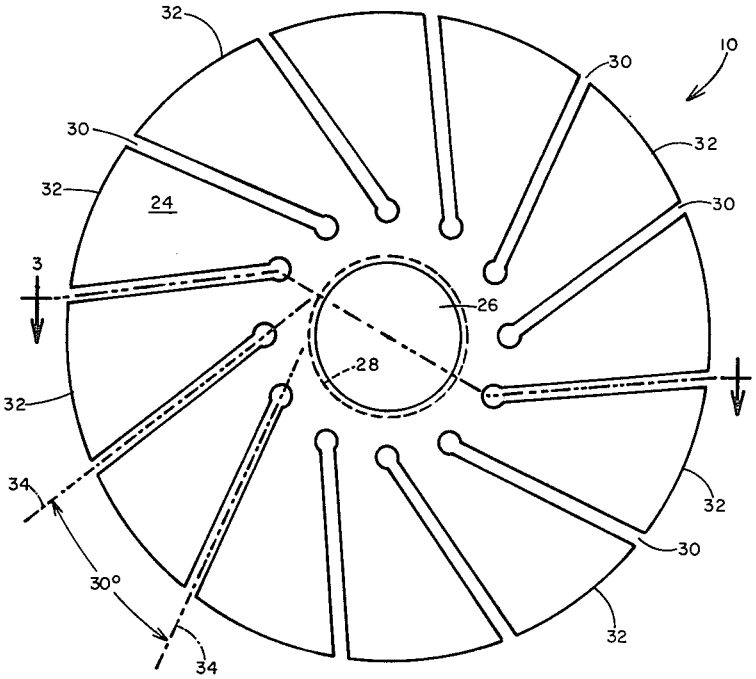
FIG. 2 is an enlarged plan view of the drag brake device before assembly with a vehicle.
Figure 3:
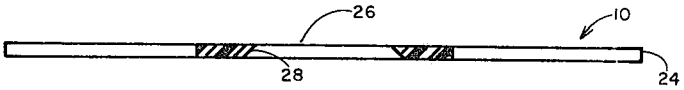
FIG. 3 is a sectional view of the device taken substantially along line 3—3 of FIG. 2.

Referring more specifically now to FIGS. 2 and 3, device 10, prior to assembly with vehicle 12, comprises a flat disc 24 of resiliently flexible plastic material such as polyethylene, or other stable, water resistant and readily molded or cut material. Disc 24 is provided with a central aperture 26, defined by a beveled inner edge 28. The bevel of edge 28 is approximately 45° with the wider portion of aperture 26 facing downwardly. The outer diameter of disc 24 is on the order of three times the diameter of hull 14, while the diameter of aperture 26 is somewhat less than the diameter of the portion of probe 18 on which it is to be mounted. In the present example, disc 24 has a diameter of 5.1 inches and a thickness of 0.12 inches.

A plurality of slots 30 are formed in disc 24, numbering 12, in this example, so as to define therebetween a like number of vanes 32. The solts 30 are each arranged so as to lie at angles of substantially 30° to the adjacent slots, and also are arranged so that the centerline 34 of each slot is substantially tangential to the central aperture 26. The resulting vanes 32 may therefore be said to be offset relative to radii of the disc 24.

When device 10 is assembled with vehicle 12, disc 24 is pressed onto probe 18 and, because of the beveled aperture edge 28 and the fact that aperture 26 is initially somewhat smaller in diameter than that portion of probe 18 onto which the disc is pressed, the disc 24 is deformed into a conical shape as illustrated in FIG. 1.

That is the normal or at rest configuration of the device 10. A suitable bonding cement is advantageously used to secure the disc 24 to the probe in addition to its resilient gripping action thereon.

Figure 4:
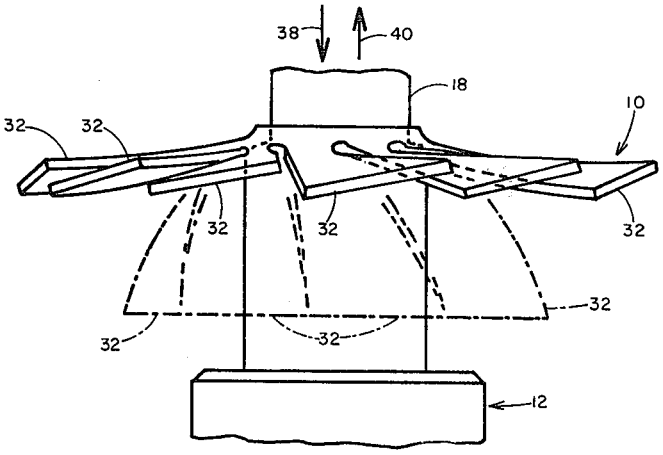
FIG. 4 is a view illustrating operational positions of the device.

In operation, and with reference now to FIG. 4, when the vehicle 12 is in a sinking or descending mode, as indicated by vector arrow 38, the vanes 32 of the device 10 are deflected upwardly from the conical rest positions of FIG. 1. Additionally, the offset configurations of the vanes 32 results in their being twisted by their resistance to passage through the water so as to assume a pitch that produces rotational movement of the vehicle 12 about its vertical longitudinal axis. The drag imposed by the device 10 and the rotation effected also by that device both serve to provide stability for the vehicle to maintain a vertical orientation. The drag provided by device 10 further serves to limit the rate of descent.

When the vehicle 12 is ascending under the powered influence of propeller 16, as shown by vector arrow 40, the vanes 32 of device 10 are deflected downwardly and inwardly from the rest position of FIG. 1 to a contracted, streamlined position as indicated in dot and dash lines in FIG. 4. The streamlined condition exhibits less area in the direction of travel and correspondingly less drag in that direction while increasing stability along the longitudinal axis of the vehicle. Some twisting of the vanes 32 occurs in the streamlined or contracted condition, thereby imparting a rotational torque to the vehicle in the same direction as is imparted during ascent. This torque can conveniently oppose reactionary torque resulting from operation of propeller 16.

In some applications it is desirable to store the vehicle 12 in a cylinder or tube and/or to launch the vehicle from a tube. It will be appreciated that the flexible nature of device 10, together with the slotted configuration thereof, renders it admirably suited to such storage and launching, in that the device 10 can be compressed to a collapsed condition as small in diameter as the hull 14 without damage or likelihood of failure when the vehicle is launched.

Obviously, other embodiments and modifications of the subject invention will readily come to the mind of one skilled in the art having the benefit of the teachings presented in the foregoing description and the drawing. It is, therefore, to be understood that this invention is not to be limited thereto and that said modifications and embodiments are intended to be included within the scope of the appended claims.

What is claimed is:

1. In combination with an underwater instrumented vehicle having an elongated cylindrical hull adapted to operate with its longitudinal axis in a vertical position, programmed to alternate between powered ascents and sinking descents, having reduced diameter probe means at the upper end of the hull and propeller means at the lower end, a drag and spin producing device comprising:

a substantially conical member formed of flexible plastic material and having a central aperture through which said probe means extends in press fit relation;

said member being segmented into a plurality of vanes by a like plurality of slots extending inwardly from the peripheral edge of said member and terminating short of said central aperture, said slots extending along lines tangential to said central aperture whereby said vanes are adapted to be twisted, upon passage of said vehicle through water, to assume a pitch which induces rotation of said device and said vehicle about said longitudinal axis;

said vanes being adapted to flex outwardly to a drag increasing position in response to said sinking descents of said vehicle and to flex inwardly to a drag reducing streamlined position in response to said powered ascents of said vehicle.

2. The device defined in claim 1, and wherein:

said plurality of vanes are twelve in number.

3. The device defined in claim 2, and wherein:

said member has an external diameter greater than that of said cylindrical hull and is flexibly compressible into a collapsed configuration having a diameter that is less than that of said hull.

* * * * *